United States Patent [19]

Faure et al.

[11] 4,351,146

[45] Sep. 28, 1982

[54] PROCESS AND DEVICE FOR PRODUCING A YARN HAVING ALTERNATE TWISTS OF OPPOSITE DIRECTIONS

[75] Inventors: Jean-Louis Faure, Roanne; Michel Vanhelle, Lille, both of France

[73] Assignee: ASA S.A., France

[21] Appl. No.: 166,331

[22] Filed: Jul. 7, 1980

[30] Foreign Application Priority Data

Sep. 7, 1979 [FR] France ..... 79 18173

[51] Int. Cl.[3] ..... D01H 5/28; D01H 5/18; D02G 3/22; D02G 3/36

[52] U.S. Cl. ..... 57/6; 57/12; 57/293; 57/328

[58] Field of Search ..... 57/293, 294, 3, 6, 9, 57/328, 12

[56] References Cited

U.S. PATENT DOCUMENTS

| | | | |
|---|---|---|---|
| 3,225,533 | 12/1965 | Henshaw | 57/293 |
| 3,367,095 | 2/1968 | Field, Jr. | 57/293 X |
| 3,415,048 | 12/1968 | Welbers | 57/293 X |
| 3,427,647 | 2/1969 | Field, Jr. | 57/293 X |
| 3,884,025 | 5/1975 | Oberender et al. | 57/293 |
| 4,006,582 | 2/1977 | Gurkaynak et al. | 57/294 |
| 4,012,894 | 3/1977 | Akachi et al. | 57/293 |
| 4,069,656 | 1/1978 | Arai et al. | 57/293 X |
| 4,114,358 | 9/1978 | Tsuchida et al. | 57/293 X |
| 4,214,430 | 7/1980 | Vogelsberg et al. | 57/6 |

*Primary Examiner*—John Petrakes

*Attorney, Agent, or Firm*—Arnold, White & Durkee

[57] ABSTRACT

A process for producing a yarn with alternate twist, which is obtained by intermittently varying the distance which the twist extends back upstream of a false twister. The variation in the distance is produced without braking the yarn and is achieved by means of a blocking device acting intermittently at a point located close to the false twister. The duration of action of the blocking device approximately corresponds to the time taken by a given point on the yarn to cover the distance from a delivery member to the false twister.

15 Claims, 5 Drawing Figures

D
P

PROCESS AND DEVICE FOR PRODUCING A YARN HAVING ALTERNATE TWISTS OF OPPOSITE DIRECTIONS

DESCRIPTION

The present invention relates to a process and device for producing a yarn having, over its length, alternate twists of opposite directions. It also relates to a device for carrying out this process and to its application to the production of self-twisting yarns.

It is already known to impart to a yarn twist alternately in the S and Z directions, whether the yarn is based on continuous filaments or discontinuous fibres.

The first technique, which was mainly to impart strength to a rove of fibres during spinning, consists of subjecting the rove to the action of a rubbing element which acts transversely relative to the direction of displacement of the rove in alternate directions.

It has also been proposed, in particular in U.S. Pat. No. 3,225,533, to subject a multifilament yarn to the action of an air jet which is directed tangentially relative to the displacement of the yarn, alternately on one side and then on the other, so as to produce successive zones of twist in the S and Z directions.

Furthermore, numerous documents have described the use of false twist spindles, under particular conditions, in order to impart this alternate twist. Although it is well known that false twist spindles, whether they work by internal friction, that is to say by contact with the surface of sheathes, or by external friction, that is to say by contact with the external surface of discs, or by any other means make it possible, under normal treatment conditions, to obtain a true twist upstream of the spindle, the yarn not having any twist on leaving the spindle, it is possible, for example by varying the speed of rotation of the twister, or the speed of passage of the yarn, or the distance which the twist extends back upstream of the spindle, to obtain yarns which possess alternate twists on leaving the twister.

Thus, U.S. Pat. No. 3,415,048 and British Pat. No. 1,139,445 describe the use of a false twist spindle which makes it possible to impart an alternate twist to a continuous multifilament yarn. The spindle rotates at a constant speed and the alternate twist is produced in the yarn wound up downstream of the spindle by varying the distance which the twist extends back upstream of the spindle and thus varying the opposite twist imparted between the spindle and winding on device. This is done by a brake which acts intermittently in the region of the said spindle, or which is displaced intermittently.

However, those processes which involve the intermittent action of the twister or its reversal do not permit use at high speeds and are mechanically complex.

Furthermore, although the technique described in U.S. Pat. No. 3,415,048 allows higher speeds, it is found that in treating a spun fibre yarn or a rove, rather than a multifilament yarn with continuous filaments, the action of the brakes intended for preventing the twist from extending back can cause breaking of the yarns or the accumulation of fibres at the brake, while in the case of yarns with a core, bunching of the fibres around the core may occur.

According to the present invention there is provided a process for the production of a yarn which possesses along its length alternate zones of S and Z twist, the process involving the steps of positively delivering a single yarn via a delivery device, imparting false twist to the yarn by means of a false twister acting continuously on the yarn and located at a position spaced from the delivery device, intermittently varying the distance over which the twist extends back upstream of the false twister, such intermittent variation being achieved without braking the yarn by means of a blocking device in the form of a positive delivery device acting intermittently on the yarn at an upstream point close to the false twister, the duration of action of the blocking device approximately corresponding to the time taken for a point on the yarn to travel from the delivery member to the false twister, and winding up the yarn so that the wound up yarn possesses, along its length, alternate zones of S and Z twist.

The present invention makes it possible to treat either yarns with continuous filaments or spun fibre yarns, or even roves, the degree of twist in each zone in the S and Z directions being moreover substantially higher than in the earlier processes.

Furthermore, the process according to the invention can be adapted for the production of self-twisting yarns, that is to say yarns produced by, in general terms, combining at least two yarns, at least one of which possesses an alternate twist, so that they wind around one another. Preferably, both the yarns have an alternate twist, the zones of twist in the same direction being either in phase or slightly out of phase relative to one another. The basic teaching of this self-twisting can be found in U.S. Pat. No. 3,225,533.

Thus, according to a preferred process of the invention, at least one further single yarn is positively delivered, spaced from the said yarn, by the or another delivery device and the two yarns are brought together so as to cause their self-twisting.

In this particular application, the invention can make it possible to obtain self-twisting yarns which, compared with the earlier yarns, exhibit numerous advantages, in particular, a higher production speed, the possibility of easily varying the length of the twist-reversing cycle, and the possibility of simply adjusting the phase difference between the two yarns, with alternate twist, intended for forming the self-twisting yarn.

Preferably, the alternate twist imparted to the yarn is stabilised downstream of the false twist member, in a zone located near the point where the yarn leaves the said member.

By virtue of the invention, it has been found that a yarn with alternate twist is obtained, which, compared with the yarns produced previously, shows a better yield of alternate twist on the yarn produced, for a given value of false twist imparted to the yarn. The invention makes it possible to produce single yarns possessing an alternate twist over their length, it being possible for these yarns to be based on continuous filaments or on fibres, and these yarns being optionally associated with a core during their production. With a single yarn, stabilisation of the alternate twist imparted to the yarn can be achieved with the aid of conventional means, such as an interlacing nozzle or a sizing treatment, arranged as close as possible to the outlet of the member imparting the false twist.

In the production, however, of self-twisting yarns, the operation of stabilising the alternate twist possessed by the yarn produced is not carried out by means of such a treatment (interlacing or sizing) but corresponds to the operation for juxtaposing the two yarns in order to cause their self-twisting, this juxtaposition also being carried out in the immediate vicinity of the zone in which the yarn leaves the false twist member, or even inside this member in the case where the latter is an internal friction spindle.

In this aspect of self-twisting, although it is possible for only one of the yarns to receive an alternate twist, it is advantageous to impart this alternate twist to both or each single yarn, this twist preferably being imparted by means of a single false twist member. In this case, of course it is necessary to keep the two yarns apart in the false twist member.

In another aspect, the present invention provides, a device for the production of a yarn which possesses, along its length, alternate zones of S and Z twist, such device including a first delivery device for delivering a single yarn, a false twister to act continuously on the yarn to impart a false twist to the yarn, and means intermittently to vary the distance which the twist extends back upstream from the false twister, such means including a blocking device in the form of a positive delivery device located at an upstream point close to the false twister which acts intermittently on the yarn for a time corresponding to the time taken for a point on the yarn to travel from the yarn delivery member to the false twister, and means to wind up the yarn.

The invention and the advantages which it provides will be more clearly understood from the following description which is given by way of example and with reference to the accompanying drawings, in which.

In what follows, the invention will be described in connection with the production of a yarn with alternate twist, or of a self-twisting yarn, from roves of fibres, this production taking place directly during the operation of stretching the said rove. A core may or may not be incorporated into the rove before it leaves the stretching zone. However, no limitation is implied and the invention can be applied to continuous filaments, if appropriate during their manufacture, for example following the operations for spinning, extrusion and stretching.

Figures 1, 4:
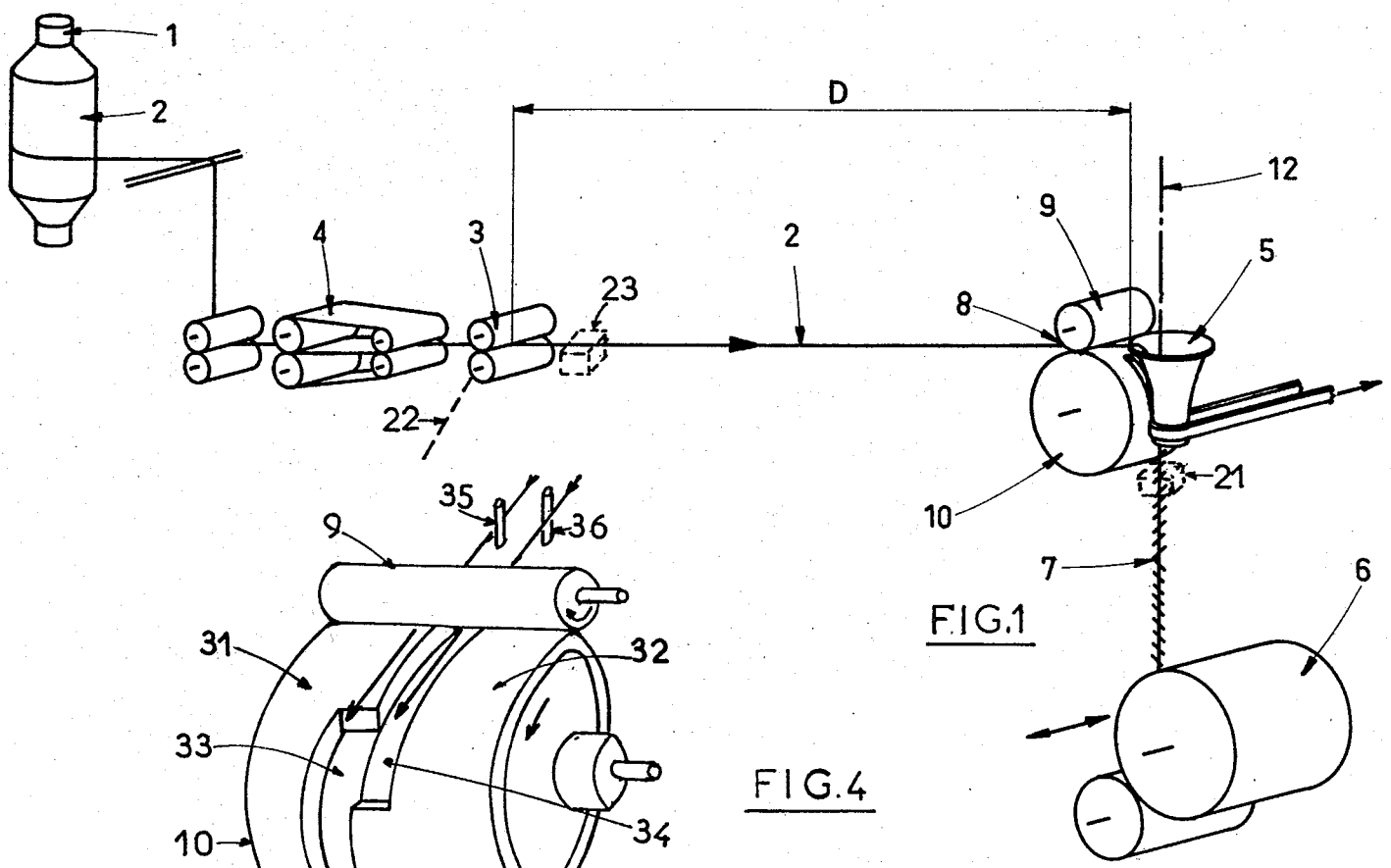
FIG. 1 is a simplified perspective view of apparatus of the invention for producing a single yarn with alternate twist.
FIG. 4 is a detailed perspective view of a device which makes it possible to vary the distance by which the twist extends back from a spindle, the spindle not being shown.

FIG. 1 shows an embodiment of the invention for the production of a single yarn with alternate twist.

The installation used comprises, in this order: a support 1 for storing the material 2 to be treated, which in the present case is a single yarn comprising a rove of fibres; a device 3 for positively delivering the said single yarn, which consists of the final pair of drawing-off rollers of a conventional stretching system 4 with a double coupling sleeve; a false twist spindle 5 which is caused to rotate at constant speed; and elements 6 for winding up the formed and twisted yarn 7.

In this embodiment, the false twist spindle 5 is an internal friction spindle, but it is obvious that it would be possible to use any other type of spindle, for example an external friction spindle or one or more friction belts.

The delivery device 3 is arranged at a relatively great distance from the false twist member 5.

An element 8 is arranged in the immediate vicinity of the inlet of the false twist spindle 5, this element making it possible to vary the distance which the twist extends back, but without clamping or otherwise braking the yarn. This element, which is described by the expression "blocking device" in the present description, consists, in one embodiment, of a positive delivery device. This acts intermittently on the yarn so that, for a duration which is approximately equal to the time taken by a given point on the yarn to cover the distance D between the delivery member 3 and the false twist member 5, the twist imparted by the spindle 5 is prevented from extending back by the blocking device 8. However, when the blocking device is inactive, the twist extends back freely as far as the delivery device 3.

Although, in the remainder of the description, the invention will be described more particularly with the use of a blocking device acting on the yarn intermittently, for equal durations in which the twist is or is not prevented from extending back, it is obvious that the durations of these two states could be unequal, with the arrangement that the blocked condition has a duration as mentioned corresponding to the time taken for yarn to travel from delivery device 3 to twister 5.

In the embodiment illustrated by the attached Figures, the blocking device 8 consists of a positive delivery device which comprises an upper roller 9 which has a smooth surface and is made, for example, of the material marketed under the trademark "Vulkolan", this roller 9 bearing on a steel roller 10 which has grooves over part of its periphery. When the yarn passes between these two rollers, and when the grooved zone comes opposite the roller 9, the yarn is not delivered by these rollers and the twist can extend back as far as the delivery device 3. On the other hand, when non-grooved parts of the roller 10 engage the roller 9, the yarn is driven positively and the twist cannot extend back. It is thus possible to vary, between these two limits, the distance of yarn over which the twist extends back. Given that rollers 9 and 10 are continuously rotated, the peripheral lengths of the grooved and non-grooved parts of roller 10 must be such that the yarn is delivered positively for a duration which is approximately equivalent to the time taken by a given point on the said yarn to cover the distance between the member 3, for delivering single yarn, and the false twist member 5.

In this embodiment, therefore, the diameter of the roller 10 is such that its perimeter is approximately equal to twice the distance D between the spindle 5 and the delivery device 3, but in the attached Figures, the relative proportions of the roller 10 and the distance D are not shown accurately in order to make the Figures clear. The roller 10, therefore, is driven at a peripheral speed which is approximately equal to the speed of displacement of the yarn 2. Thus the twist is alternately allowed and prevented from extending back beyond blocking device 8.

It has been found that, by operating in this manner, a yarn with alternate twist is produced at the outlet of the spindle and this yarn possesses, compared with the earlier yarns, a much higher level of alternate twist for a given imparted false twist.

Other types of twist blocking device 8 can be employed. Thus, for example, a delivery device might consist of two positively driven rollers, with one of the rollers being mounted on a movable support by which it can be brought intermittently into contact with the second roller.

For the production of a single yarn with alternate twist, as in FIG. 1, the installation also comprises, immediately at the outlet of the false twist spindle 5, a member 21 of known type which makes it possible to stabilise the twist, it being possible for this member to consist, for example, of a compressed-air interlacing nozzle or a system for sizing the yarns.

An installation of the above described type can also be used for producing spun fibre yarns which have an internal core. In this case, the core is preferably fed into the apparatus upstream of the stretching rollers 3, such a core 22 being shown in dashes in FIG. 1, either above or below the rove 2, but as close as possible to the central part of the latter.

Furthermore, in order to remove the flocks and the fluff which may be produced, suction means can be provided, these consisting, for example, of conventional pipettes preferably arranged near the outlet of the delivery device 3.

For the case where a core is to be incorporated the installation can include a false twist member 23, such as a compressed-air nozzle, which facilitates the winding of the fibres around the core and the centering of the latter, this false twist member being arranged in the vicinity of the outlet of the delivery device 3. Condensers can be arranged upstream of the stretching system 3, also in order to assist in centering the core in the rove.

Figures 2, 3, 5:
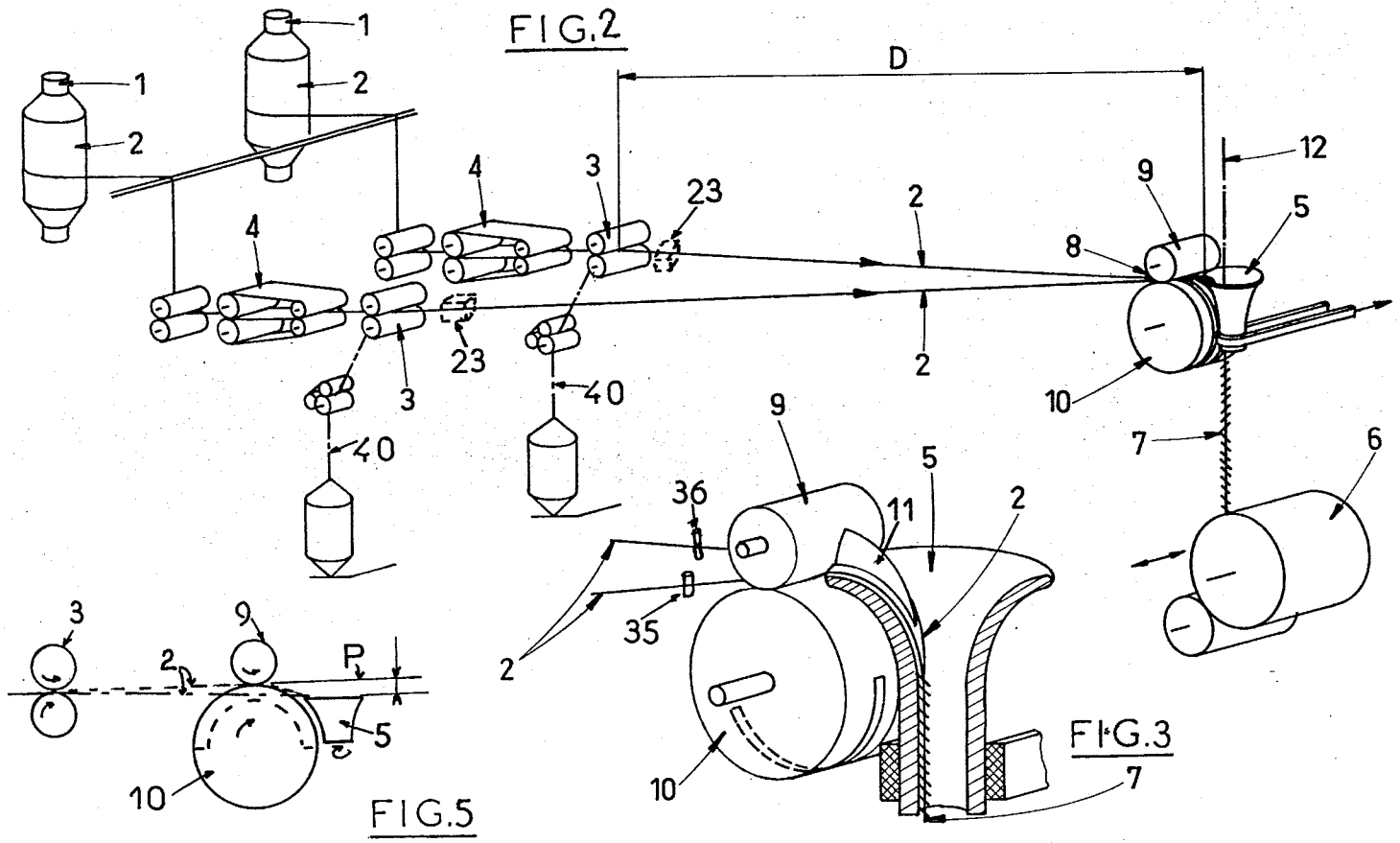
FIG. 2 is also a simplified perspective view of apparatus of the invention for producing, from two single yarns, a yarn with alternate twist.
FIG. 3 is an enlarged perspective view of a false twist member and of an element which makes it possible to vary the distance by which the twist extends back therefrom.
FIG. 5 is a schematical side view of a modification concerning the position of the spindle, relative to the element which makes it possible to vary the distance by which the twist extends back.

FIGS. 2, 3 and 4 illustrate a second installation produced according to the invention for simultaneously treating two yarns which are then combined by self-twisting before they are wound up.

Compared with the installation described in connection with FIG. 1 above, differences lie in the provision of a second system 1, 3, 4 for feeding a second yarn 2. Also, the intermittent blocking device 8 consists again of a delivery device, which is of the same type as that described above, but which is modified so that it can act on, or allow back twist in both the yarns.

The blocking device 8, of which a particular embodiment is shown in greater detail in FIG. 4, comprises a smooth roller 9, for example made of "Vulkolan", and a steel roller 10 possessing grooves on its periphery. This roller 10 is advantageously produced in two juxtaposed parts 31, 32, which possess respective grooves 33, 34 in the central zone of the assembled roller. The perimeter of the roller 10 and the length of the grooves 33 and 34 are determined in the same manner as previously so that each yarn is alternately driven or free, the periods being the time taken for a point on the yarn to travel from device 3 to false twister 5. However, it is possible, in an embodiment of this type, for the zones of alternate twist produced in the individual yarns 2 to be in phase or brought out of phase in a simple manner by rotationally offsetting the two grooves 33, 34 relative to one another.

Guides, for example fingers 35 and 36 made of ceramic, are provided upstream of the intermittent blocking device 8 in order to keep the two yarns parallel.

In this embodiment, the stabilisation of the alternate twist imparted to the two yarns is achieved by the self-twisting of these two yarns onto one another.

If an internal friction spindle is used as the false twist element, as illustrated in the attached Figures, it is advantageous to provide a separating guide 11 (FIG. 3), closely fitting the surface of the spindle in the friction zone. This keeps the two yarns apart up to the point where the self-twisting takes place.

Furthermore, if an internal friction spindle is used, then as shown in greater detail in FIG. 3, the spindle advantageously has a concave external surface which enables it closely to fit the periphery of the roller 10 so as to bring the edge of the spindle as close as possible to the line of action of the blocking device 8, that is to say to the contact line between the rollers 9 and 10.

Finally, as illustrated in FIG. 5, it is possible to arrange the spindle 5 at a level which is slightly below the plane P defined as including the contact line between the rollers of the delivery device 3 and the contact line between the rollers 9 and 10, but is slightly above the bottom of the grooves in the roller 10. This makes it easier for the twist imparted by the spindle 5 to extend back freely when the blocking device 8 is inactive, because contact between the yarn and the roller 9 is reduced.

The grooves provided in the roller 10 must be sufficiently wide not to engage the edges of the yarns.

The following examples further illustrate the invention.

EXAMPLE 1

A rove 2, based on wool fibres (average length: 62 millimeters) and of NM 2 (5,000 decitex), is treated on an installation of the type illustrated in FIG. 1, the stretching ratio produced at the stretching system 4 being 20 and the speed of the outlet rollers 3 being 200 meters per minute. An internal friction spindle 5, which possesses a concave external surface and is driven at a speed of 1,800 rpm, is used as the false twist spindle. The winding-up speed of the yarn 7 produced is 207 meters per minute, and the delivery device 3 is arranged at a relatively long distance of 27 cms from the false twist member 5. The blocking device 8 is arranged in the immediate vicinity of the inlet of the false twist spindle 5, and consists of an upper roller 9 which possesses a smooth surface made of Vulkolan, and has a diameter of 5 centimeters, and a lower roller 10 having a diameter of 10 centimeters, and thus a perimeter which is approximately equal to twice the distance between the spindle 5 and the delivery device 3.

The roller 10 possesses a notch over half its periphery and is driven at a speed of 384 rpm, its peripheral speed thus being about 205 meters per minute. Furthermore, a sizing device 21, which makes it possible to stabilise the alternate twist produced, is arranged at the outlet of the false twist spindle 5.

Under these conditions, a spun fibre yarn of NM 40 (250 dtex) is obtained, which possesses, over its length, zones of twist alternately in the S and Z directions, each zone having a length of about 27 centimeters and a twist of 75 turns (in each zone).

EXAMPLE 2

Example 1 is repeated, but a core 22, which consists of a polyester yarn texturised by false twist, of 72 decitex per 33 strands, is incorporated immediately before the inlet of the delivery device 3.

A rove of wool (average length: 62 millimeters), of NM 3 (3,300 decitex), is used as the rove of fibres 2, the stretching ratio produced at stretching device 4 being 35.

A yarn with a core, of which the covering of fibres possesses an alternate twist, is obtained at the outlet of the false twist spindle, this yarn having a gauge of NM 60 (167 dtex).

EXAMPLE 3

This example is in accordance with FIGS. 2 to 4, and concerns the production of a self-twisting yarn by simultaneously treating two yarns.

Compared with Example 1 above, the differences lie in the provision of a second system 1, 3,4 for a second yarn 2, in that the blocking device 8 has two parallel grooves 33, 34 to treat the two yarns 2 separately and that separating guides 35, 36 are arranged upstream of the blocking device 8, with a separator 11 being arranged in the vicinity of the spindle 5 (FIG. 3) so as to keep the two yarns well apart and to define the point of combination, at which self-twisting takes place.

By proceeding in the same manner as in Example 1, with two identical roves 2, a self-twisting yarn of NM 20 (500 decitex), which possesses zones of alternate twist having a length of 27 centimeters, is obtained at the outlet of the spindle 5.

This yarn can be used as such and is perfectly stable.

EXAMPLE 4

Example 3 is repeated, but a core yarn 40, which consists of a polyester yarn texturised by false twist, of 72 decitex per 33 strands, is incorporated at the inlet of each outlet roller 3.

Roves of wool (average length: 62 millimeters), having a NM of 3 (3,300 decitex), are used as the rove of fibres. The stretching ratio produced at stretching device 4 is 35. A yarn assembled by self-twisting, each of the constituents of which has a gauge of NM 60 (167 decitex), is obtained at the outlet of the spindle 5.

Of course, the invention is not limited to the above embodiments, but also covers all the variants thereof. Thus, it is possible to obtain fancy yarns by varying the feed and/or winding-up speeds of the yarn or yarns.

Furthermore, as stated previously, in particular in the case where it is desired to produce spun yarns with a core, it can be advantageous to impart a false twist to the yarn immediately at the outlet of the delivery device 3, for example by means of a compressed-air nozzle.

In other possible modifications it is possible to combine, with the yarns produced, a yarn 12 (FIGS. 1 and 2) fed in directly along the axis of the false twist spindle 5.

Finally, the yarn obtained can be wound up in any known manner, during which a complementary twist may or may not be imparted thereto.

We claim:

1. A process for the production of a yarn which possesses along its length alternate zones of S and Z twist, the process involving the steps of positively delivering a single yarn via a delivery device, imparting a false twist to the yarn by means of a false twister acting continuously on the yarn and located at a position spaced from the delivery device, intermittently varying the distance over which the twist extends back upstream of the false twister, such intermittent variation being achieved by means of a blocking device in the form of a positive delivery device acting intermittently on the yarn at an upstream point close to the false twister, the duration of action of the blocking device approximately corresponding to the time taken for a point on the yarn to travel from the delivery device to the false twister, and winding up the yarn so that the wound up yarn possesses, along its length, alternate zones of S and Z twist.

2. A process as claimed in claim 1, wherein the alternate twist imparted to the yarn is stabilised at a point located close to the outlet of the false twister.

3. A process as claimed in claim 1, wherein at least one further single yarn is positively delivered, spaced from the said yarn, and the two yarns are brought together so as to cause their self-twisting.

4. A process as claimed in claim 3, wherein the self-twisting of the yarns takes place in the immediate vicinity of the outlet zone of the false twister.

5. A process as claimed in claim 3, wherein such an alternate twist is imparted to two single yarns by means of a single false twister, the two yarns being held apart as they enter the false twister.

6. A process as claimed in claim 3, wherein a core is incorporated during the treatment of the single yarns, this incorporation being carried out upstream of the delivery device.

7. A process as claimed in claim 1, wherein the false twist is imparted by means of friction of a moving surface of the false twister.

8. A process as claimed in claim 1, wherein a core is incorporated during the treatment of the single yarn, this incorporation being carried out upstream of the delivery device.

9. A process according to claims 6 or 8 wherein the yarn is subject to the action of a second false twister arranged adjacent the outlet of the delivery device.

10. A process as claimed in claim 1, wherein the yarn is subjected to the action of a further false twister arranged adjacent the outlet of the delivery device.

11. A device for the production of a yarn which possesses, along its length, alternate zones of S and Z twist, such device comprising in combination a first delivery device for delivering a single yarn, a false twister to act continuously on the yarn to impart a false twist to the yarn, and means intermittently to vary the distance which the twist extends back upstream from the false twister, such means including a blocking device in the form of a positive delivery device located at an upstream point close to the false twister, and means causing said blocking device to act intermittently on said yarn for a time corresponding to the time taken for a point on the yarn to travel from the yarn delivery device to the false twister, and means to wind up the yarn.

12. A device as claimed in claim 11, wherein the positive delivery device which is the blocking device comprises two positively driven rollers, and a support for one of the rollers, said support being constructed to bring said one roller intermittently into contact with the other roller.

13. A device as claimed in claim 11, wherein the positive delivery device which is the twist-blocking device comprises two rollers, and grooves for receiving the yarn provided on only part of the periphery of one of said rollers such that the yarn passing between the rollers is not delivered when it is in the groove and is delivered when it is not in the groove.

14. A device as claimed in claim 11 and further including a further false twist member adjacent said first delivery device.

15. A device as claimed in claim 11 and further including means to supply a further single yarn and to bring said single yarns together in the region of said false twister so as to self-twist.

* * * * *

UNITED STATES PATENT AND TRADEMARK OFFICE

CERTIFICATE OF CORRECTION

PATENT NO. : 4,351,146

DATED : September 28, 1982

INVENTOR(S) : Jean-Louis Faure and Michel Vanhelle

It is certified that error appears in the above—identified patent and that said Letters Patent is hereby corrected as shown below:

Title page, item [73] Assignee, please insert before "ASA S.A." -- INSTITUT TEXTILE DE FRANCE, AGENCE NATIONALE DE VALORISATION DE LA RECHERCHE (ANVAR) and --

Signed and Sealed this

*Fifteenth* Day of *November 1983*

[SEAL]

*Attest:*

GERALD J. MOSSINGHOFF

*Attesting Officer*

*Commissioner of Patents and Trademarks*